US005399813A

United States Patent [19]

McNeill et al.

[11] Patent Number: 5,399,813

[45] Date of Patent: Mar. 21, 1995

[54] CATEGORY 5 TELECOMMUNICATION CABLE

[75] Inventors: David B. McNeill, Winston-Salem; Jerry B. Kilpatrick, Greensboro, both of N.C.

[73] Assignee: The Whitaker Corporation, Wilmington, Del.

[21] Appl. No.: 82,340

[22] Filed: Jun. 24, 1993

[51] Int. Cl.[6] ..... H01B 11/02; H01B 7/08

[52] U.S. Cl. ..... 174/117 F; 174/34; 174/113 AS; 174/117 AS

[58] Field of Search ..... 174/117 R, 117 F, 117 FF, 174/117 AS, 113 AS, 32, 34

[56] References Cited

U.S. PATENT DOCUMENTS

| | | | |
|---|---|---|---|
| 3,549,788 | 12/1970 | Apen et al. | 174/107 |
| 4,012,577 | 3/1977 | Lang et al. | 174/117 F |
| 4,680,423 | 7/1987 | Bennett et al. | 174/117 F |
| 4,755,629 | 7/1988 | Beggs et al. | 174/34 |
| 4,777,325 | 10/1988 | Siwinski | 174/34 |
| 4,873,393 | 10/1989 | Friesen et al. | 174/34 |
| 5,038,002 | 8/1991 | Viaud | 174/117 R |
| 5,132,488 | 7/1992 | Tessier et al. | 174/34 |
| 5,162,609 | 11/1992 | Adriaenssens et al. | 174/34 |

FOREIGN PATENT DOCUMENTS

| | | | |
|---|---|---|---|
| 2523653 | 12/1976 | Germany | 174/34 |

OTHER PUBLICATIONS

BICSI Newsletter; *AT&T Systimax Structured Cabling Systems;* Dec. 1992; vol. 13 No. 3.

EIA/TIA Bulletin; *Technical Systems Bulletin Additional Cable Specifications for Unshielded Twisted Pair Cables;* pp. 1–5; Nov. 1991.

*Primary Examiner*—Morris H. Nimmo

*Attorney, Agent, or Firm*—William B. Noll

[57] ABSTRACT

This invention is directed to a high performance electrical telecommunication transmission cable, particularly for undercarpet applications. More precisely, this invention is directed to a low-profile, high performance flat cable, where the cable may be subjected to potentially damaging compressive forces from walking on an overlying carpet. The cable comprises a plurality of conductors arranged as plural sets of twisted pairs, with each conductor consisting of an inner conductive core surrounded by insulation, an outer dielectric member having plural longitudinally extending chambers, where each chamber includes two sets of the twisted pairs, spaced-apart and arranged in side-by-side fashion and generally parallel. The height of the chamber is dimensioned to exceed the wrap diameter of a set of a twisted pair of conductors. Adjacent chambers include a dielectric vertically disposed wall therebetween to provide resistance to compressive forces, and the twisted pairs therewithin exhibit a preferred twist on the order of ½ to 1 inch lay length. For cable lengths of at least 1000 feet, the cable is characterized by an attenuation and NEXT loss which exceed the Category 5 requirements of EIA TSB-36.

4 Claims, 3 Drawing Sheets

CATEGORY 5 TELECOMMUNICATION CABLE

The present invention is directed to a high performance electrical telecommunication transmission cable, such as for undercarpet applications, where the cable is intended to meet or exceed the requirements for Category 5 cable, as hereinafter defined, while further offering structural integrity to the cabling system.

As a result of increased Local Area Networking (LAN) speeds and improved connecting devices, an effort evolved to develop high performance unshielded twisted-pair (UTP) cable to meet the emerging requirements of the telecommunications industry. U.S. Pat. No. 4,873,393 to Friesen et al. purports to meet the foregoing requirements with a cabling system suited for the transmission of substantially error-free data at relatively high rates over relatively long distances. According to the patent, this performance is achieved by the use of at least two pairs of individually insulated conductors, where the pairs of individually insulated conductors are enclosed in a tubular member comprising a plastic insulation material. The twist length of each pair of insulated conductors should not exceed a value equal to the product of about forty and the outer diameter of the plastic insulation. Further, the twist lengths among the conductor pairs are varied in accordance with a twist frequency scheme modulated by non-uniform increments of twist frequency. While purporting to meet the requirements of Category 5, the system thereof falls significantly short in providing structural integrity to the cable, whereby it may be used in undercarpet telecommunication transmission systems without damaging the system and interfering with its performance.

U.S. Pat. No. 4,777,325 to Siwinski discloses a low profile cable system for undercarpet applications, where such system appears to offer some limited structural integrity to the cable, but not the high performance requirements for present day transmission systems. The cable system as disclosed therein comprises a plurality of twisted pairs of conductors positioned side-by-side, each pair in separate compartments formed within a hollow envelope of an extruded outer sheath. Separator ribs, which do not extend across the entire height of the sheath, are provided to prevent lateral movement of twisted pairs out of their respective compartments. Laterally extending solid members may be included to withstand compressive loads.

The present invention, whose contributions will become apparent in the following description, particularly when read in conjunction with the accompanying drawings, combines high performance with structural integrity, especially for undercarpet applications.

SUMMARY OF THE INVENTION

This invention relates to a high performance electrical telecommunication transmission cable, such as for undercarpet applications. More precisely, this invention is directed to a low-profile, high performance flat cable, where the cable may be subjected to potentially damaging compressive forces. The cable comprises a plurality of conductors arranged as plural sets of twisted pairs, with each conductor consisting of an inner conductive core surrounded by insulation, an outer dielectric member having plural longitudinally extending chambers, where each chamber includes two sets of the twisted pairs, spaced-apart and arranged in side-by-side fashion and generally parallel. The height of the chamber is dimensioned to exceed the wrap diameter of a set of a twisted pair of conductors. Adjacent chambers include a dielectric vertically disposed wall therebetween to provide resistance to compressive forces, and the twisted pairs therewithin exhibit a twist on the order of ½ to 1 inch lay length. For cable lengths of at least 1000 feet, the cable is characterized by an attenuation and NEXT loss which exceed the Category 5 requirements of EIA TSB-36.

BRIEF DESCRIPTION OF DRAWINGS

FIG. 3 is a sectional view taken along line 3—3 of FIG. 2.

DETAILED DESCRIPTION OF PREFERRED EMBODIMENT

The present invention relates to a high performance transmission cable that meets or exceeds the performance requirements for Category 5 cable, as defined by the Electronic Industries Association (EIA) standard TSB-36 for Unshielded Twisted Pair Cable (UTP).

Two important test criteria for UTP under Category 5 are attenuation and near end crosstalk (NEXT) loss, where attenuation is commonly derived from swept frequency signal measurement at the output of 1000 ft. of cable. The maximum attenuation for UTP of 24 AWG thermoplastic insulated conductors, for Category 5, in a given frequency range is listed in TABLE I, hereinafter. The second important test criteria is NEXT loss which is commonly derived from swept frequency measurement using a network analyzer or an s-parameter test set. That is, a balanced input signal is applied on a disturbing pair (excited) while the crosstalk signal is measured at the output port on a disturbed pair (monitored) at the near end of the cable. At the far end, the disturbed and disturbing pair are terminated in a 100 Ohm resistance. The minimum values, though such values are actually negative, for Category 5 are listed in TABLE II. An explanation of the test criteria, insofar as they relate to the present invention and the prior art, exemplified by U.S. Pat. No. 4,777,325, will be covered later.

Figure 1:
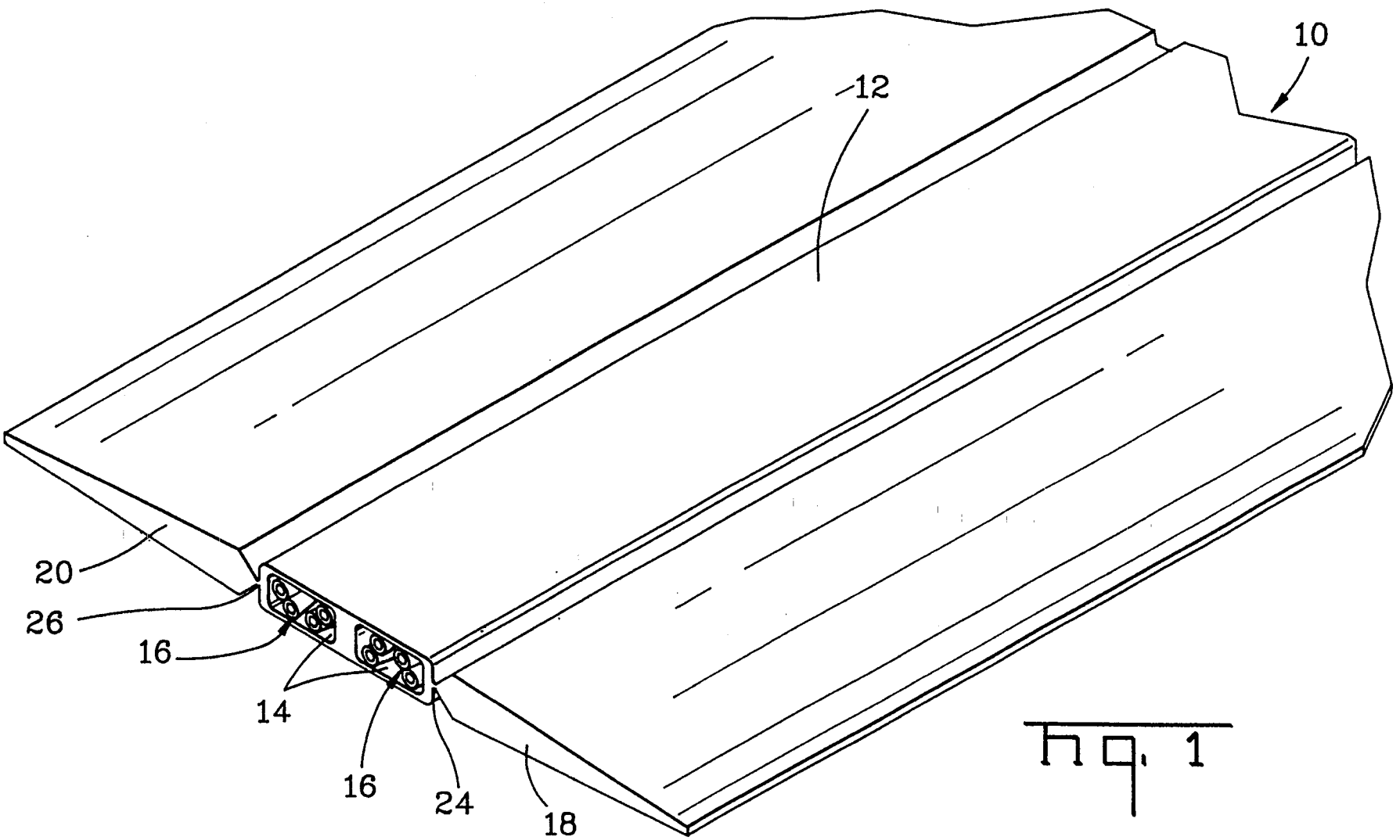
FIG. 1 is a top perspective view of a low-profile, high performance cable according to the invention.
Figure 2:
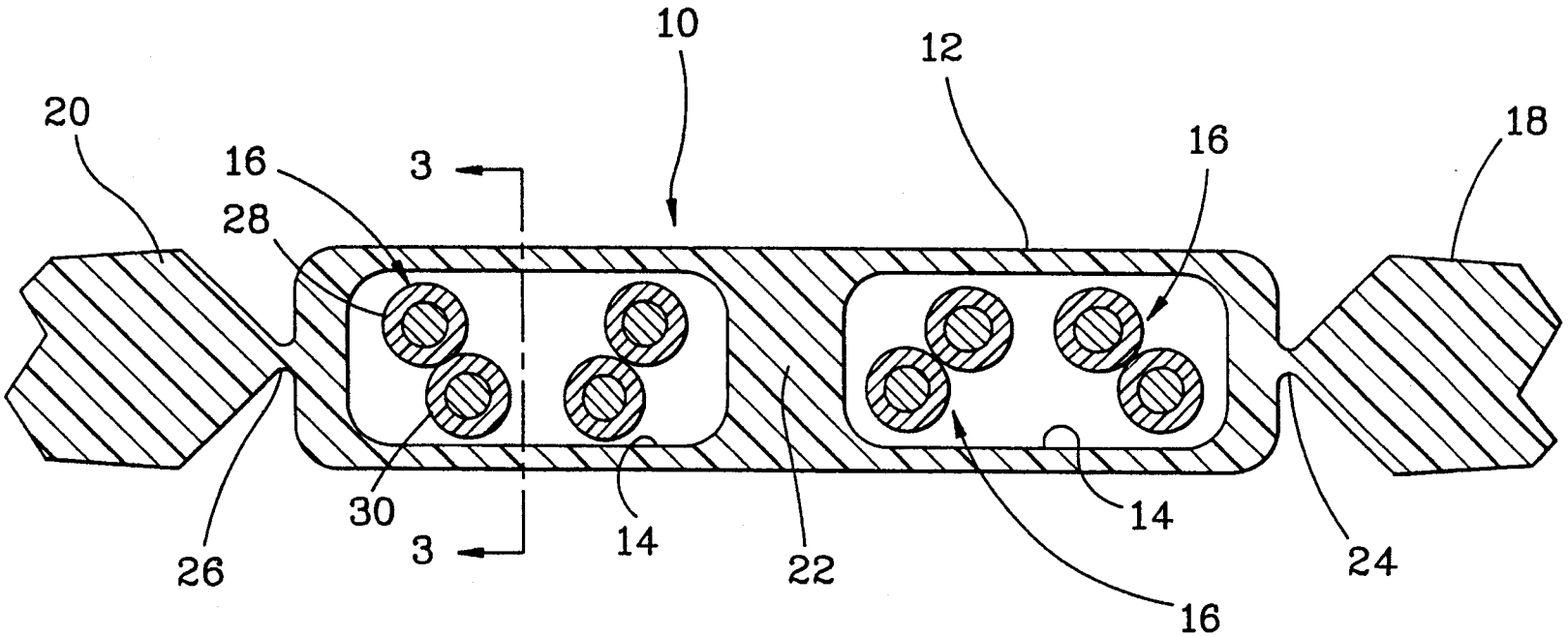
FIG. 2 is an enlarged partial sectional view taken laterally through the cable of FIG. 1.
Figure 7:
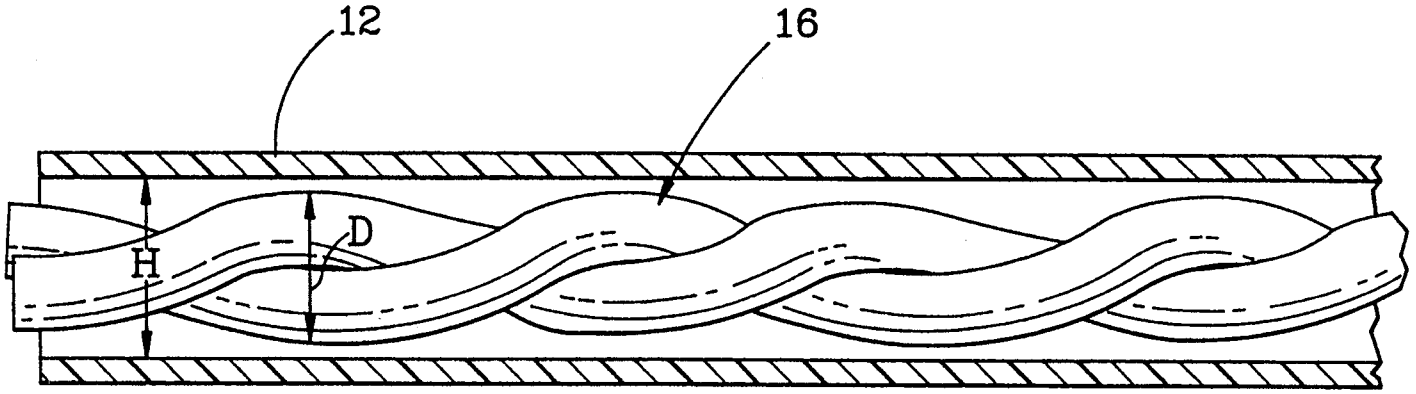

Turning now to the invention as illustrated in the accompanying FIGS. 1 to 3, the UTP cable 10 hereof, preferably four pairs of conductors and particularly intended for undercarpet applications, comprises a continuously extruded outer insulative jacket 12, formed of a dielectric material, such as polyvinyl chloride (PVC), containing preferably a pair of elongated chambers 14, where each chamber is intended to receive two pairs of twisted conductors 16. As a part of the extrusion process, a pair of laterally extending tapered members 18, 20, or wings, along with a broad internal rib 22, or section may be formed. These two laterally adjacent members 18 and 20 are joined to the edges of the centrally disposed insulative jacket 12 by a thin extruded section 24 and 26. Although each of the laterally adjacent members 18 and 20 are tapered toward their free ends, the maximum height of each solid member 18 and 20 adjacent the conductive sheath or jacket is substantially equal in height to the sheath 12. This arrangement, coupled with the central internal rib 22, provides improved resistance to compression, such as may be experienced from walking on an overlying carpet.

As best illustrated in FIG. 2, the individual conductors, such as conductors 28 and 30 which form each of the conductors pairs 16, are positioned generally side-by-side within the outer sheath or jacket 12. Each individual conductor 28 and 30 has an inner conductor core surrounded by insulation, where a commercial conductor may be identified as 24 AWG. These insulated wires are then twisted in a conventional fashion along their length to form twisted pairs, where the twist is less than one inch, i.e., a 360° rotation of the conductor in less than one inch of conductor length, preferably a twist of from ½ to 1 inch lay length. Two pairs of the twisted conductors 16 are arranged in a single chamber 14, where the wrap diameter "D", namely, twice the conductor diameter, is less than the height "H" of the chamber 14. That is, "H" is from 5 to 15% greater than the wrap diameter "D" to provide ample air space about the twisted conductors, see FIG. 3. From a practical standpoint, the dimensioning therewithin is such that a given twisted pair of conductors 16 may be readily withdrawn from its chamber 14, such as by pulling.

From a closer inspection of FIG. 2, which illustrates the relative position of the conductor pairs 16 within chamber 14, it will be seen that considerable air space is provided. It was discovered that this increased air space, plus the broad central rib 22 to space the chambers 14, dramatically improved the attenuation of the cable making it possible to achieve Category 5 in a low-profile undercarpet cable.

This improved performance can best be illustrated in the following data, where four unshielded twisted pairs of 24 AWG thermoplastic insulated conductors, enclosed by a thermoplastic jacket, were subjected to the Category 5 performance requirements for attenuation and crosstalk. For these tests, a first cable was prepared in accordance with the profile of FIG. 2 (Invention), and a second cable in accordance with the profile of four individual twisted pairs, each within its separate chamber under U.S. Pat. No. 4,777,325.

TABLE I

| Attenuation Characteristics - dB Max. per 1000 ft. | | | |
|---|---|---|---|
| Frequency MHz | Cat. 5 Spec. | U.S. Pat. No. 4,777,325 | Invention |
| 1.0 | 6.3 | 6.3 | 5.1 |
| 4.0 | 13 | 13.3 | 11.5 |
| 8.0 | 18 | 19.5 | 16.6 |
| 10.0 | 20 | 22 | 18.6 |
| 16.0 | 25 | 28 | 23.7 |
| 20.0 | 28 | 32 | 26.6 |
| 25.0 | 32 | 36 | 29.9 |
| 31.25 | 36 | 40 | 33.4 |
| 62.5 | 52 | 59 | 48.4 |
| 100 | 67 | 78 | 63.3 |

TABLE II

| Near End Crosstalk Loss Characteristics - dB Min. | | | |
|---|---|---|---|
| Frequency MHz | Cat. 5 Spec. | U.S. Pat. No. 4,777,325 | Invention |
| 1.0 | 62 | 74 | 71 |
| 4.0 | 53 | 71 | 63 |
| 8.0 | 48 | 62 | 62 |

TABLE II-continued

| Near End Crosstalk Loss Characteristics - dB Min. | | | |
|---|---|---|---|
| Frequency MHz | Cat. 5 Spec. | U.S. Pat. No. 4,777,325 | Invention |
| 10.0 | 47 | 60 | 61 |
| 16.0 | 44 | 59 | 57 |
| 20.0 | 42 | 58 | 54 |
| 25.0 | 41 | 58 | 53 |
| 31.25 | 40 | 55 | 44 |
| 62.5 | 35 | 47 | 45 |
| 100 | 32 | 42 | 40 |

From Table I, it will be seen that the prior art cable, made in accordance with the teachings of U.S. Pat. No. 4,777,325, in the frequency range of from 4.0 to 100.0 MHz, failed to meet the attenuation performance requirements of Category 5 cable. In contrast, throughout the full frequency range of from 1.0 to 100.0 MHz, the cable of this invention exceeded the performance requirements for Category 5 cable. In all cases, the dB was below the maximum levels set out in the specification.

Table II tells a different story. Such Table shows that both cables satisfactorily met the NEXT performance requirements for Category 5 cable. As may be true in some situations, enhancement of one property or characteristic may often be accomplished with the attending loss or deterioration of a second property or characteristic. However, in the present case, it was possible to significantly improve attenuation without a serious loss in NEXT performance. Thus, this invention has resulted in a low profile undercarpet cable that meets and/or exceeds the performance requirements for Category 5 cable.

We claim:

1. A low-profile, high performance flat cable suitable for under carpet applications, where said cable may be subjected to potentially damaging compressive forces, said cable comprising a plurality of conductors arranged as plural sets of twisted pairs, with each conductor consisting of an inter conductive core surrounded by insulation, an outer dielectric member having plural longitudinally extending chambers, where each said chamber includes two sets of said twisted pairs spaced-apart and arranged in side-by-side fashion and generally parallel, where the height of said chambers exceeds the wrap diameter of a set of a twisted pair of conductors, and where adjacent chambers include a dielectric vertically disposed wall therebetween to provide resistance to said compressive forces, and said twisted pairs exhibit a twist on the order of ½ to 1 inch lay length and said cable for lengths of at least 1000 feet is characterized by an attenuation of less than 67 dB at a frequency of 100 MHz, and NEXT loss in excess of 32 dB at a frequency of 100 MHz.

2. The cable according to claim 1, wherein said outer dielectric member is provided with a pair of tapered wing portions laterally extending therefrom.

3. The cable according to claim 1, wherein there are two said chambers with each containing two sets of twisted pairs of conductors.

4. The cable according to claim 1, wherein the wrap diameter of each said twisted pair of conductors is a predetermined dimension, and the height of said chamber is from 5 to 15% greater than said predetermined dimension.

* * * * *